US007670117B1

(12) United States Patent
Achterman

(10) Patent No.: US 7,670,117 B1
(45) Date of Patent: Mar. 2, 2010

(54) FLUID METERING DEVICE

(75) Inventor: Kermit Achterman, La Canada Flintridge, CA (US)

(73) Assignee: Kermit L. Achterman & Associates, Inc., La Canada Flintridge, CA (US)

( * ) Notice: Subject to any disclaimer, the term of this patent is extended or adjusted under 35 U.S.C. 154(b) by 244 days.

(21) Appl. No.: 12/001,241

(22) Filed: Dec. 11, 2007

(51) Int. Cl.
*F04B 1/26* (2006.01)
*F04B 49/00* (2006.01)

(52) U.S. Cl. ..... 417/270; 417/306; 417/308; 417/435; 60/453

(58) Field of Classification Search ..... 417/270, 417/435, 306, 308; 60/453
See application file for complete search history.

(56) References Cited

U.S. PATENT DOCUMENTS 2,383,369 A * 8/1945 Curtis ..... 137/197
4,142,841 A * 3/1979 Claar et al. ..... 417/213
4,213,744 A 7/1980 Davis
5,362,222 A 11/1994 Faig
5,486,106 A 1/1996 Hehl
5,580,585 A 12/1996 Holzschuh
5,762,973 A 6/1998 Holzschuh
5,792,483 A 8/1998 Siegrist
6,089,849 A 7/2000 Bulgrin
6,299,427 B1 10/2001 Bulgrin
6,675,870 B2 1/2004 Tilak
7,128,542 B2 10/2006 Suzuki
2003/0235506 A1 12/2003 Ichinose

FOREIGN PATENT DOCUMENTS

EP 0704963 3/1996

* cited by examiner

*Primary Examiner*—Charles G Freay
(74) *Attorney, Agent, or Firm*—Klein, O'Neill & Singh, LLP

(57) ABSTRACT

A fluid metering device for monitoring flow of fluid is provided. The fluid metering device comprises: an electric motor; and a housing having a manifold section, a motor adapter plate and a pressure retaining container, said pressure retaining container encompassing a pressurized chamber having a hydraulic pump placed in the pressurized chamber; and the manifold section including an air bleed valve and a pressure biased relief valve for maintaining pressure within the housing.

11 Claims, 4 Drawing Sheets

FLUID METERING DEVICE

BACKGROUND

1. Technical Field

The present disclosure relates generally to a fluid metering device, and more particularly, to a fluid metering device for use in a direct chill casting system.

2. Description of the Related Art

Direct chill casting (also referred to as "DC casting") is utilized to manufacture metal billets. DC casting may be horizontal DC casting or vertical DC casting. For vertical DC casting, the casting apparatus has a casting pit beneath floor level of the apparatus with vertically oriented casting cylinders situated above the casting pit.

Typically, the casting process involves pouring molten metal into a casting cylinder of a mold assembly. The casting cylinder gravitates slowly in the casting pit which cools down the molten metal. Mold assembly is further cooled by a water cooling system provided around the mold assembly. Lubricants are added to the mold to prevent sticking of molten or solid metal to the sides of the cylinder. Lubricants also trap any slag particles that may still be present in the metal and bring them to the top of the pool to form a floating layer of slag.

The casting pit serves as a catch basin for the cooling water and is also subject to hot metal spills. These metal spills result in effecting the quality of manufactured billets. It is important to monitor the speed of movement of casting cylinder to prevent metal spills, frozen molds or imperfections due to air inclusion.

Current DC casting systems use electro hydraulic servo control systems and coriolis flow meter feedback transducers for monitoring the speed of casting cylinder in the DC casting process. These electro hydraulic servo control systems and coriolis flow meters are complex to use and expensive to maintain and repair.

Therefore there is a need for a flow metering device that monitors the flow of fluid in a DC casting apparatus.

SUMMARY

In one embodiment, a fluid metering device for monitoring flow of fluid is provided. The fluid metering device comprises: an electric motor; and a housing having a manifold section, a motor adapter plate and a pressure retaining container, said pressure retaining container encompassing a pressurized chamber having a hydraulic pump placed in the pressurized chamber; and the manifold section including an air bleed valve and a pressure biased relief valve for maintaining pressure within the housing.

In another embodiment, a fluid metering device for monitoring flow of fluid is provided. The fluid metering device for monitoring flow of fluid, comprises: a vector controlled AC motor; and a housing having a manifold section, a motor adapter plate and a pressure retaining container, said pressure retaining container encompassing a pressurized chamber having a hydraulic pump placed in the pressurized chamber; and the manifold section including an air bleed valve and a pressure biased relief valve for maintaining pressure within the housing; wherein the vector controlled AC motor is connected to the hydraulic pump by means of a coupling shaft, said coupling shaft being hydraulically sealed within the pressurized chamber of the housing.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DETAILED DESCRIPTION

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved method and apparatus for DC casting. DC casting is used for preparing metal alloys, including magnesium and aluminum alloys.

To facilitate an understanding of the various embodiments, the general architecture and operation of an overall DC casting system will be described. The specific architecture and operation of the various embodiments are then described with reference to the DC casting system.

Figure 1:
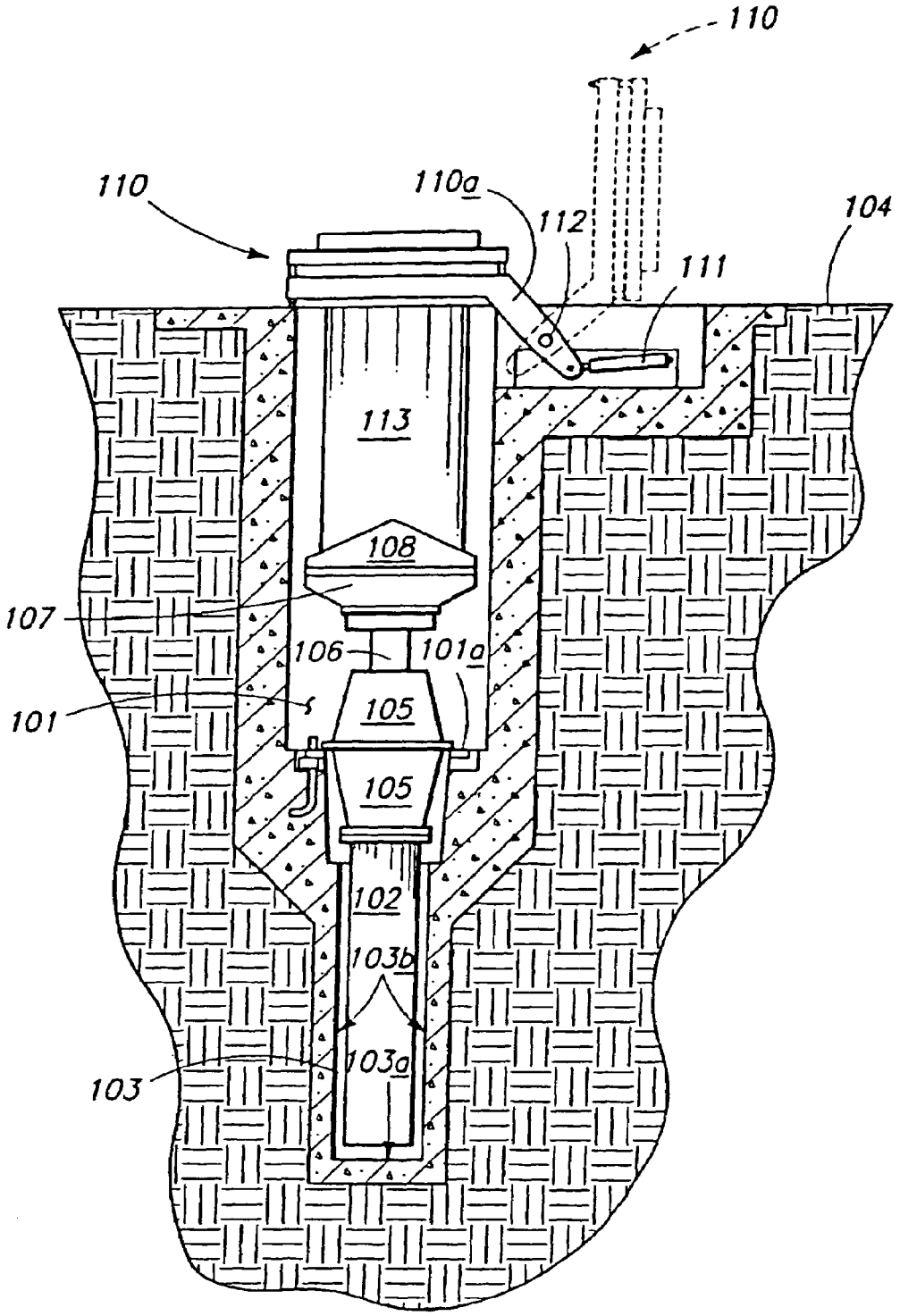
Fig 1 PRIOR ART
FIG. 1 is a process flow diagram for direct chill casting as known in the prior art.

FIG. 1 shows the vertical casting of aluminum beneath the elevation level of the floor in a casting pit. Directly beneath the casting pit floor 101*a* is a caisson 103, in which the hydraulic cylinder barrel 102 for the hydraulic casting cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with ingot or castpart 113 being partially formed. Castpart 113 is on the starting block base 108.

While the starting block base 108 in FIG. 1 only shows one starting block 108 and pedestal 105, there are typically several of each mounted on each starting block base, which simultaneously cast billets, special shapes or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a predetermined rate, thereby lowering the ram 106 and consequently the starting block 108 at a predetermined and controlled rate. The mold is controllably cooled or chilled during the process to assist in the solidification of the emerging ingots or billets, typically using water cooling means.

The molten metal is cooled in the mold and billets are formed. The emerging billets must be sufficiently solidified so that they maintain their desired shape. There is typically a mold air cavity between the emerging solidified metal and the lower portion of the mold and related equipment.

Since the casting process generally utilizes fluids, including lubricants, there are conduits and/or piping designed to deliver the fluid to the desired locations around the mold cavity. Working in and around a casting pit and molten metal can be potentially dangerous and it is desired to continually find ways to increase safety and minimize the danger or accident potential to which operators of the equipment are exposed.

The control of the casting cylinder speed is one of the most critical controls used in the direct chill casting process. The cylinder speed related problems that may occur include metal spill, frozen molds and imperfections caused by air inclusion or speed variations.

If the cylinder speed is slightly faster than the optimum speed, the metal can fail to freeze as it exits the mold. This causes a molten metal spill into the casting pit. On the contrary, if the cylinder speed is slightly slower than the optimum speed, even if momentarily, the molten metal may freeze prior to its exit from a mold. Since the cooling water is continually sprayed and the mold is always filled with metal, if this occurs, the flow stops through that mold and the metal in it freezes. This may damage the mold.

If any rapid speed variation of the cast cylinder occurs, it results in one or several imperfections in the cast billet. Due to the hostile environment caused by hot molten metal and cooling water along with lubricants and other release agents, it is not practical to put any type of electronic speed measuring device in that location. Also, due to the long stroke of the cylinder, it is not practical to install an internal electronic speed measuring device inside of it.

Accordingly, the most practical method of controlling the speed of the casting cylinder is to control the flow of fluid (lubricant and other fluids) coming out of it using a flow meter. The conventional systems use a coriolis type flow meter to monitor the flow of fluid. The information from the flow meter is directed to an electro-hydraulic servo control system, which in turn, controls a servo valve controlling the flow of the fluid. This process require high maintenance and is quite complex. Therefore, there is room for improvement in this field and a need exists to develop a direct chill casting cylinder speed control system that avoids the complexity of the electro hydraulic servo systems currently being used. The present invention provides a flow metering device for measuring flow of fluids from the casting cylinder of a direct chill casting apparatus.

Figure 2:
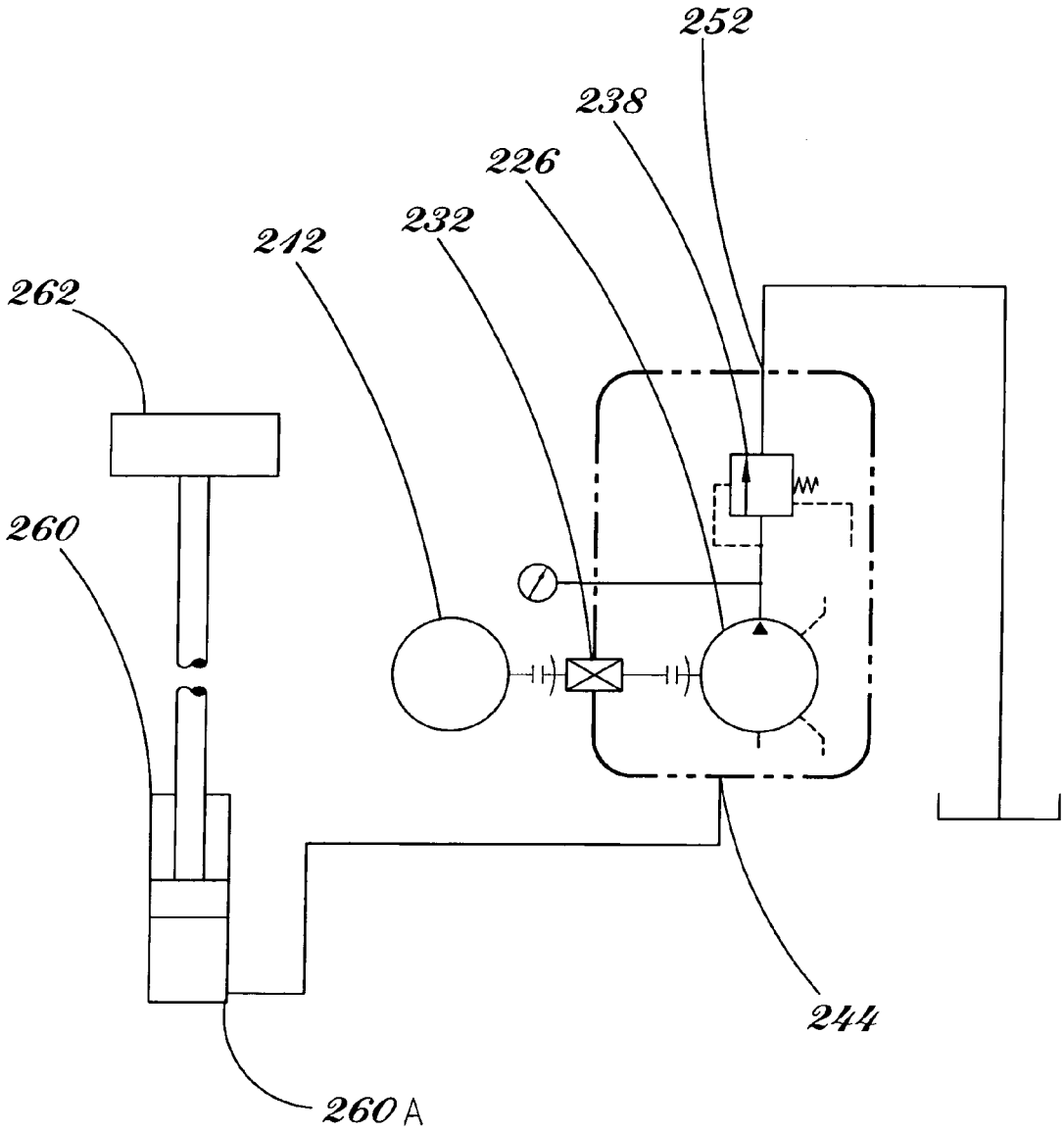
FIG. 2 is a schematic representation of a fluid metering system, according to one embodiment.
Figure 3:
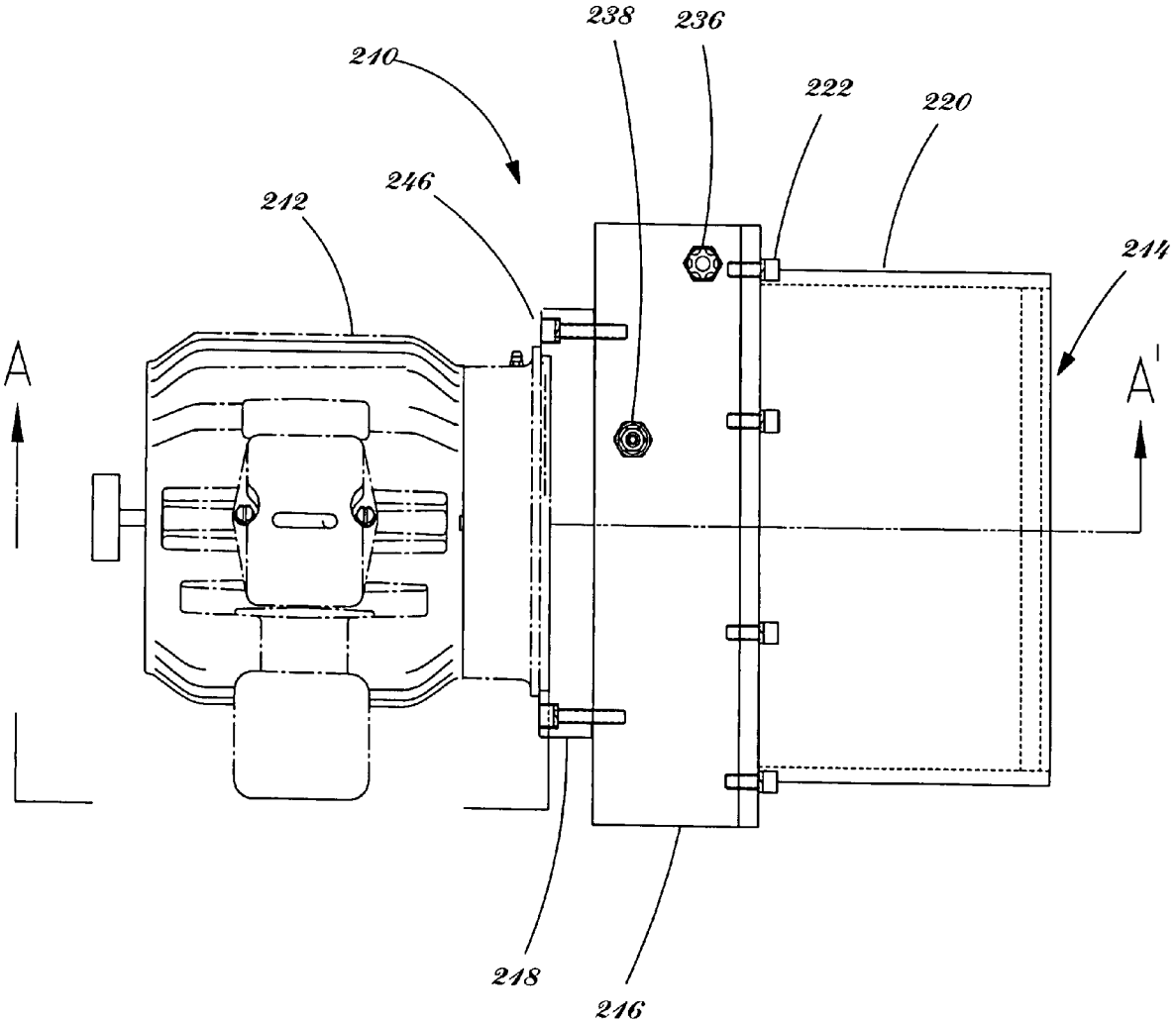
FIG. 3 is an plan view of the fluid metering unit, according to one embodiment.
Figure 4:
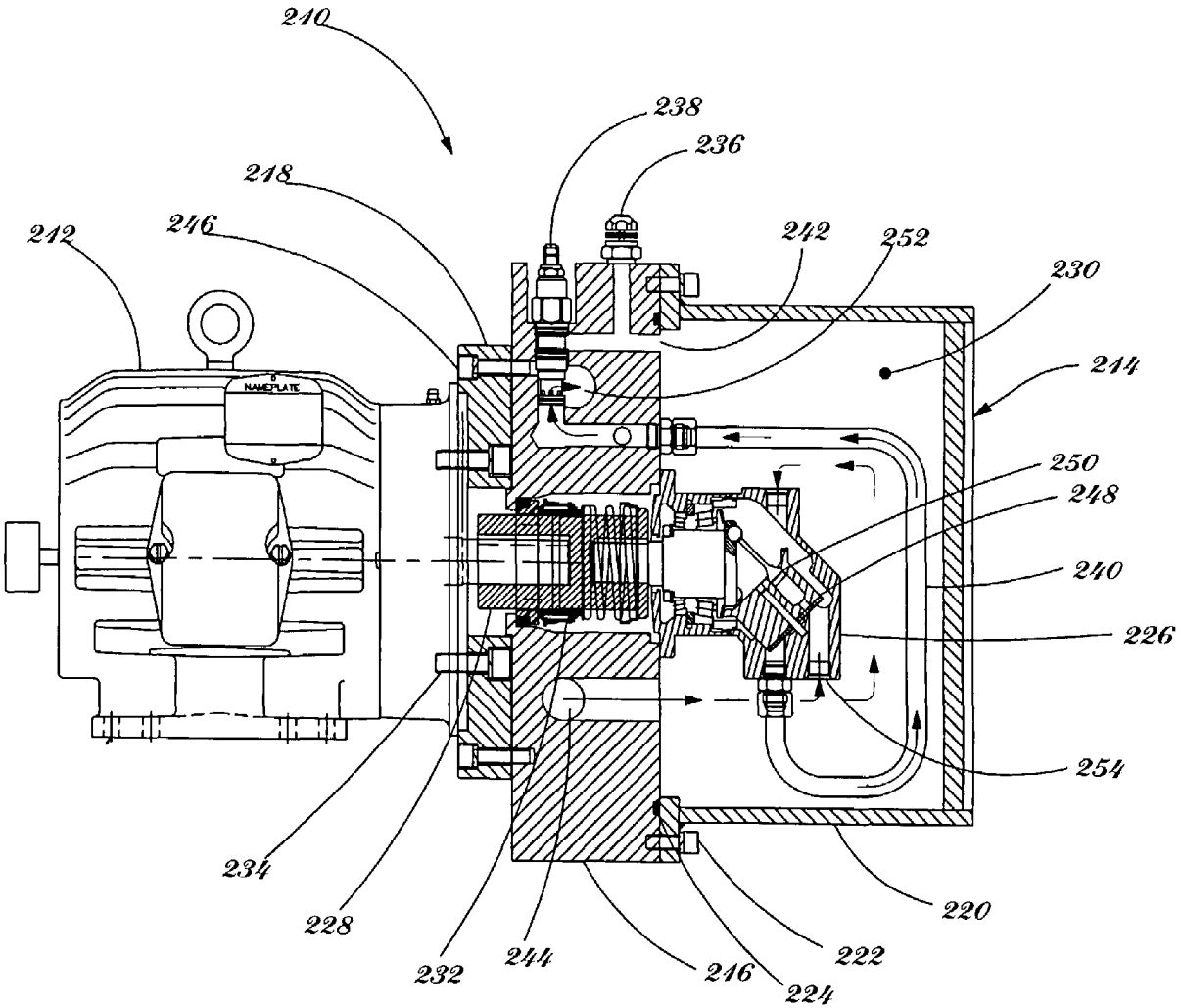
FIG. 4 is a cross-section of the fluid metering unit along A-A' FIG. 3, according to an embodiment.

In one embodiment, a fluid metering device 210 which facilitates metering the flow from the casting cylinder in the casting pit is provided. FIG. 2 shows a fluid metering device 210 which receives fluid from an outlet port 260A of the casting cylinder 260. The fluid flows to an inlet of the fluid metering device 210. FIGS. 2-4 show the fluid metering device 210 and its components in greater detail.

The flow metering pump 210 includes a housing 214 connected to an electric motor 212. Motor 212 is preferably a vector controlled AC electric motor.

Housing 214 has a pressure retaining canister 220 which encompasses a pressurized chamber 230. Housing 214 further includes a manifold section 216 and a motor adapter plate 218. A conventional hydraulic pump 226 is placed inside housing 214 and is in fluid communication with the inlet port 244 of the housing 214.

Motor 212 is affixed to the motor adapter plate 218 by conventional means, for example, using screws 234. Motor adapter plate is also affixed to the manifold section by conventional means, for example, screws 246. Motor 212 drives the hydraulic pump 226 by means of a connecting coupling shaft 228. The coupling shaft 228 is hydraulically sealed within the pressurized chamber 230 of the housing 214 by means of a high pressure mechanical seal 232.

Housing 214 helps maintain pressure of the pump at a desired level. Pressure retaining container 220 is fixed to the manifold section 216 by conventional means, for example cap screws 222. Container 220 is further sealed to the manifold section using an O-ring 224. Manifold section 216 also includes an air bleed valve 236 to entrap and remove air from the pressurized chamber 230. Further, a pilot pressure biased relief valve 238 is installed in the manifold section 216 of the housing 214.

The fluid outlet flow of the hydraulic pump 226 is connected to the inlet of the pressure biased relief valve 238 by means of a tube assembly 240. The outlet port of the pressure biased relief valve 238 is in fluid communication with the outlet port 252 of the manifold section 216.

The pilot port of the pressure biased relief valve 238 commutes with the pressurized chamber 230 by means of passage 242. The pressure biased relief valve 238 has an internal pilot ratio of 1:1. That is, the fluid pressure present at the pilot port of the valve adds to the value of the opening pressure by that ratio. For example if the valve is adjusted to an opening pressure of 50 PSI and 100 PSI is present at the pilot port, the opening pressure of the valve becomes 150 PSI.

Hydraulic fluid from a direct chill casting cylinder 260 (via outlet port 260A) is directed to the inlet port 244 of the housing 214. The pressurized chamber 230 of the housing 214 completely fills with fluid. Air is bled through the air bleed valve 236. The fluid in the pressurized chamber 230 also enters the inlet port 254 of the hydraulic pump 226.

This fluid is at the load induced pressure of the casting cylinder 260 outlet. As a cast progresses, the cast cylinder 260 load 262 increases and therefore the load induced pressure increases.

When the hydraulic pump 226 is driven by the vector controlled AC electric motor 212, fluid in the chamber 230 is expelled across the pressure biased relief valve 238, through the outlet port 252 of the manifold section 216, and back to the main hydraulic power unit fluid reservoir (not shown). This discharge pressure is always higher than the inlet pressure by an amount equal to the initial setting of the relief valve, which is normally about 40-80 PSI. For example, if the load 262 induced inlet pressure from the casting cylinder 260 is 200 PSI, then the discharge pressure from the hydraulic pump 226 will be 250 PSI. This configuration insures that the differential pressure across all of the internal sealing surfaces in the hydraulic pump 226, and specifically across the valve plate 248, and piston rings 250, is always a constant and equal to the unbiased initial setting of the pressure biased relief valve 238.

By maintaining a constant differential pressure across the internal sealing surfaces of the hydraulic pump 226, the volumetric efficiency of that pump 226 is nearly constant. With the volumetric efficiency of the pump being constant, the outflow of the pump is a virtual linear result of the pump speed.

The hydraulic pump 226 speed is accurately controlled by the vector controlled AC electric motor 212. This results in accurate metering of the outflow fluid from the casting cylinder 260 which produces accurate control of the cylinder speed. Throughout the entire cast cycle, as the cast cylinder 260 load increases and the load induced pressure increases, the hydraulic pump 226 volumetric efficiency remains constant. In an exemplary embodiment, the relief valve 238 has an initial setting of only 50 PSI, so that if the fluid in the pressure retaining container 220 were at atmospheric pressure, then the pump outlet flow would be at 50 PSI before passing the relief valve 238. This implies that the differential pressure across the internal sealing surfaces is only 50 PSI. The pressure biased relief valve 238 has a pilot ratio of 1:1. That means that any pressure applied to the pilot port of the relief valve increases its setting by that amount. The pilot port of the pressure biased relief valve 238 is connected to the interior of the pressure containing vessel 220, so that whatever pressure is present in that vessel 220 adds to the initial 50 PSI relief valve pressure 238. In a DC casting process, when the casting process begins, the load induced cylinder pressure is about 100 PSI. This fluid is directed into the inside of the pressure retaining container 220, and is reflected on the internal case of the device, the inlet port of the pump, and on the pilot port of the pressure biased relief valve 238. The setting of the relief valve 238 then increases by the 100 PSI to a setting of 150 PSI. The discharge fluid from the pump is increases to 150 PSI. However, internal pressure in the case of the pump is at 100 PSI. This means that the differential pressure across the sealing surfaces has remained at 50 PSI. As the load induced pressure increases, to say 200 PSI, as the cast continues and more metal is placed on the platen, the pressure in the pressure retaining container also rises to 200 PSI. The relief valve setting increases to 250 PSI, and the internal pressure in the case of the pump rises to 200 PSI. Now with the pump outlet flow at 250 PSI and the case pressure at 200 PSI, the differential pressure across the sealing surfaces is still 50 PSI.

Thus the differential pressure across the internal sealing surfaces of the pump 226 is maintained at a very low and very constant 50 PSI. With this arrangement, the pump volumetric efficiency is a virtual constant, and with the speed being controlled with a vector controlled AC motor, the pump flow, and therefore the cylinder speed, is accurately controlled. Vector controlled AC motors with internal feedback encoders produce a typical speed tolerance of ±0.1%.

Although the present description relates to use of fluid metering device for use in direct chill casting apparatus, it is understood that this device may be used in other similar process that require accurate control of a fluid flow of a broad pressure spectrum. Such processes are found in petroleum distillation, chemical manufacturing, and other industrial applications.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A fluid metering device for monitoring flow of fluid, comprising:

an electric motor; and a housing having a manifold section, a motor adapter plate and a pressure retaining container, said pressure retaining container encompassing a pressurized chamber having a hydraulic pump placed in the pressurized chamber; and the manifold section including an inlet port communicating with the pressurized chamber, an air bleed valve and a pressure biased relief valve communicating with the pressurized chamber for maintaining pressure within the housing.

2. The fluid metering device of claim 1, wherein the electric motor is a vector controlled ac motor.

3. The fluid metering device of claim 1, wherein the motor is connected to the hydraulic pump by means of a coupling shaft.

4. The fluid metering device of claim 1, wherein the coupling shaft is hydraulically sealed within the pressurized chamber of the housing by means of a mechanical seal.

5. The fluid metering device of claim 1, wherein fluid outlet flow of the hydraulic pump is connected to an inlet of the pressure biased relief valve by means of a tube assembly.

6. The fluid metering device of claim 1, wherein the pressure biased relief valve is in fluid communication with an outlet port of the manifold section.

7. A direct chill casting apparatus having a fluid metering device of claim 1 for controlling speed of casting cylinder of the casting apparatus.

8. A fluid metering device for monitoring flow of fluid, comprising:

a vector controlled AC motor; and a housing having a manifold section, a motor adapter plate and a pressure retaining container, said pressure retaining container encompassing a pressurized chamber having a hydraulic pump placed in the pressurized chamber; and the manifold section including an inlet port communicating with the pressurized chamber, an air bleed valve and a pressure biased relief valve communicating with the pressurized chamber for maintaining pressure within the housing;

wherein the vector controlled AC motor is connected to the hydraulic pump by means of a coupling shaft, said coupling shaft being hydraulically sealed within the pressurized chamber of the housing.

9. The fluid metering device of claim 8, wherein the fluid outlet flow if the hydraulic pump is connected to an inlet of the pressure biased relief valve by means of a tube assembly.

10. The fluid metering device of claim 8, wherein the pressure biased relief valve is in fluid communication with an outlet port of the manifold section.

11. A direct chill casting apparatus having a fluid metering device of claim 8 for controlling speed of casting cylinder of the casting apparatus.

* * * * *